US008100725B2

(12) United States Patent
Su et al.

(10) Patent No.: US 8,100,725 B2
(45) **Date of Patent: *Jan. 24, 2012**

(54) ELECTRICAL CONNECTOR WITH IMPROVED CONTACTS

(75) Inventors: Ping-Sheng Su, Tu-Cheng (TW); Li-Song Cao, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/853,472

(22) Filed: Aug. 10, 2010

(65) Prior Publication Data

US 2011/0034080 A1 Feb. 10, 2011

(30) Foreign Application Priority Data

Aug. 10, 2009 (CN) ..... 2009 1 0305406

(51) Int. Cl.
*H01R 24/00* (2006.01)

(52) U.S. Cl. ..... 439/660

(58) Field of Classification Search ..... 439/660, 439/607.48, 607.5
See application file for complete search history.

(56) References Cited

U.S. PATENT DOCUMENTS 7,393,247 B1 * 7/2008 Yu et al. ..... 439/638
7,537,488 B2 * 5/2009 Iwakawa ..... 439/660
7,559,805 B1 7/2009 Yi et al.

* cited by examiner

*Primary Examiner* — Phuong Dinh
(74) *Attorney, Agent, or Firm* — Wei Te Chung; Andrew C. Cheng; Ming Chieh Chang

(57) ABSTRACT

An electrical connector includes an insulative housing (1) defining a chamber (1150); a set of contacts (2, 3) retained in the insulative housing, the contacts including a set of first type of contacts (32, 33, 34, 35) having contacting portions (302) exposed to the chamber and each being positioned horizontally, and a set of second type of contacts (31, 36) having contacting portions (302) exposed to the chamber and each being positioned vertically, at least one of the first type of contacts having a shorting bridge (304, 305) integrally connecting with one of the second type of contacts and having a tail portion (303) co-owned with the one of the second type of contacts for being soldered; and a metal shell (6) enclosing the insulative housing.

20 Claims, 7 Drawing Sheets

ELECTRICAL CONNECTOR WITH IMPROVED CONTACTS

BACKGROUND OF THE INVENTION

1. Field of the Invention

The present invention relates to an electrical connector, and more particularly to an electrical connector having improved contacts.

2. Description of Related Art

At present, Universal Serial BUS (USB) is a widely used input/output interface adapted for many electronic devices, such as personal computer and related peripherals. In 1994, Intel, HP, IBM, NEC etc. together founded USB-IF to define a spec of USB. Nowadays, USB-IF has published several editions for USB, and transmitting rate of USB has becomes higher and higher. As development of electronic industry, higher transmitting rate of USB based connection accessory is needed.

A USB 3.0 specification over USB 2.0 has been disclosed to be adopted for transmitting high speed data. However, the USB 3.0 receptacle or plug will need more additional contacts for transmitting data, the increased number of the contacts will make the USB 3.0 receptacle soldered to a PCB complicatedly or make the USB 3.0 plug soldered to a cable complicatedly.

Hence, an improved electrical connector with an improved grounding means is desired to overcome the above problems.

BRIEF SUMMARY OF THE INVENTION

According to one aspect of the present invention, an electrical connector comprises: an insulative housing defining a chamber; a plurality of contacts retained in the insulative housing, the contacts comprising a set of first type of contacts defining contacting portions exposed to the chamber and each being positioned horizontally, and a set of second type of contacts defining contacting portions exposed to the chamber and each being positioned vertically, at least one of the first type of contacts having a shorting bridge integrally connecting with one of the second type of contacts and having a tail portion co-owned with the one of the second type of contacts for being soldered; and a metal shell enclosing the insulative housing.

According to another aspect of the present invention, an electrical plug comprises: an insulative housing defining a second chamber recessed backwardly from a front face thereof; a metal shell enclosing the insulative housing to form a first chamber restricted by the metal shell and the insulative housing under a condition that the first chamber is located above the second chamber and is narrower than the second chamber; a plurality of first contacts having elastic first contacting portions extending into the first chamber and first tail portions for being electrically connecting to electrical wires of a cable; a plurality of second contacts having stiff second contacting portions extending into the second chamber and second tail portions for being electrically connecting to other electrical wires of the cable, the second contacts comprising a first power contact, a second grounding contact, a second power contact, and a third grounding contact, the second contacting portions of the first power contact and the second grounding contact being located at top and bottom sides of the second chamber and being parallel to each other along a height direction, the second contacting portions of the second power contact and the third grounding contact being located at two lateral sides of the second chamber and being parallel to each other along a transverse direction perpendicular to the height direction; wherein the second and third grounding contacts have a first bridge portion integrally connecting therebetween and commonly own one second tail portion for being connected with one electrical wire to achieve effects of grounding, the first and second power contacts have a second bridge portion integrally connecting therebetween and commonly own one tail portion for being connected with one electrical wire to achieve effects of transfer of power therein.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
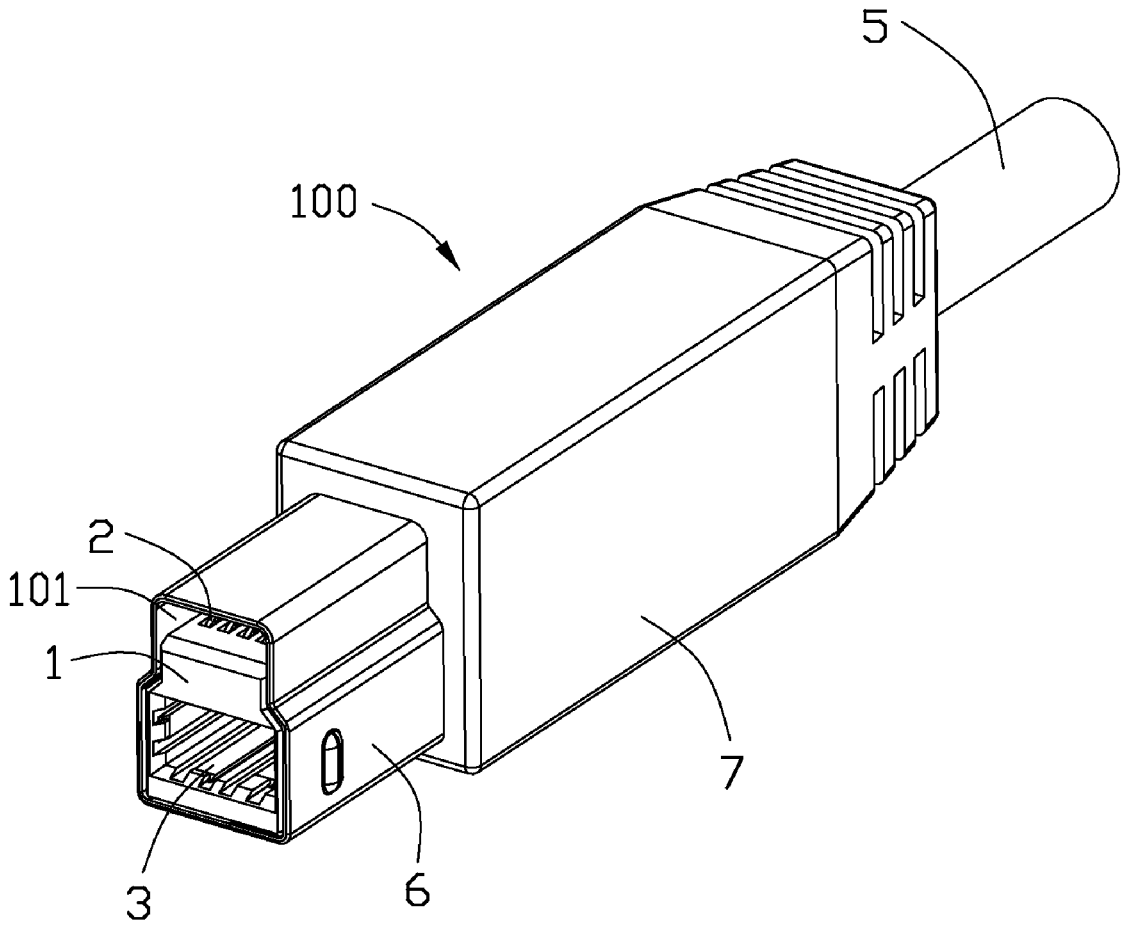
FIG. 1 is a perspective view of an electrical plug according to the present invention.
Figure 2:
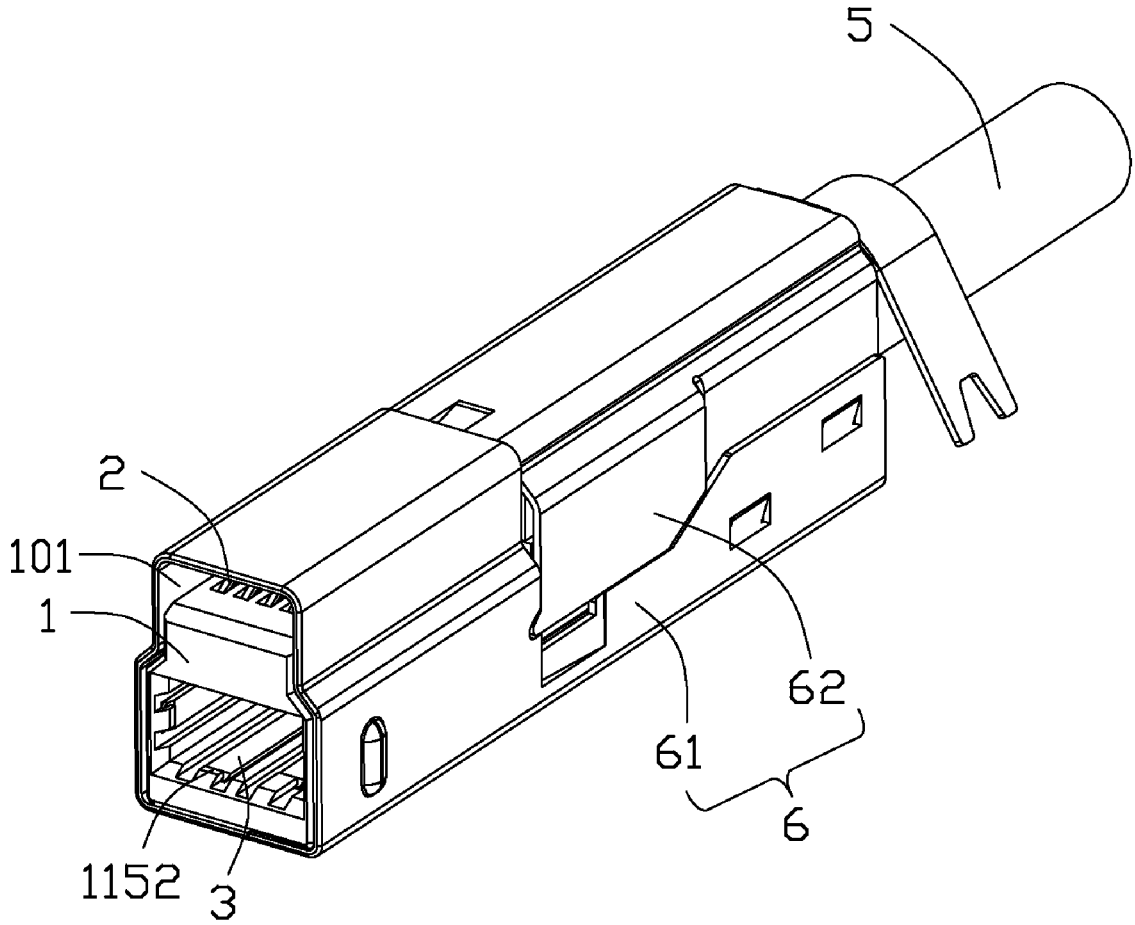
FIG. 2 is a perspective view of the electrical plug with an plastic case removed therefrom shown in FIG. 1.
Figure 3:
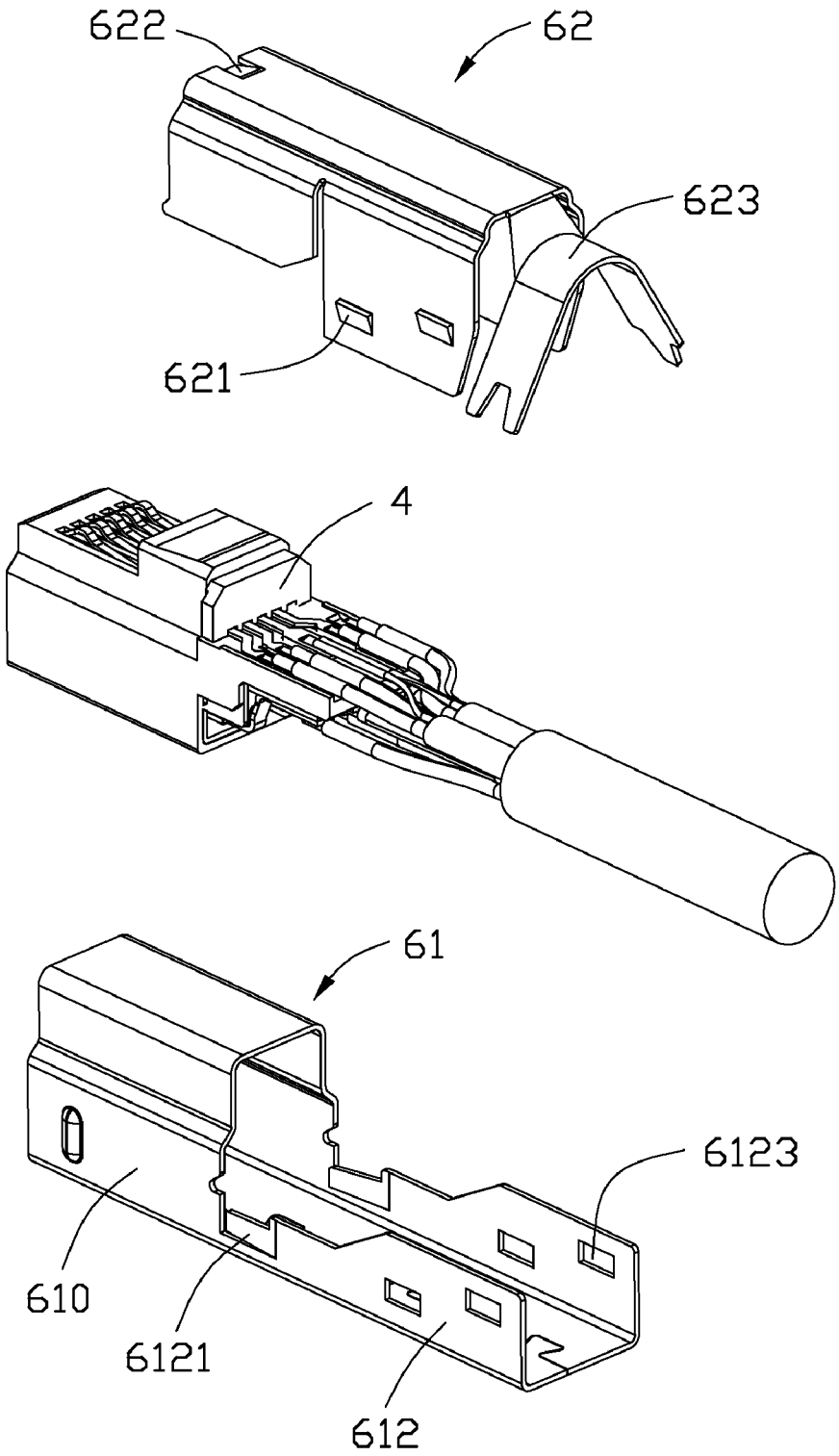
FIG. 3 is a partly exploded view of the electrical plug shown in FIG. 2.
Figure 4:
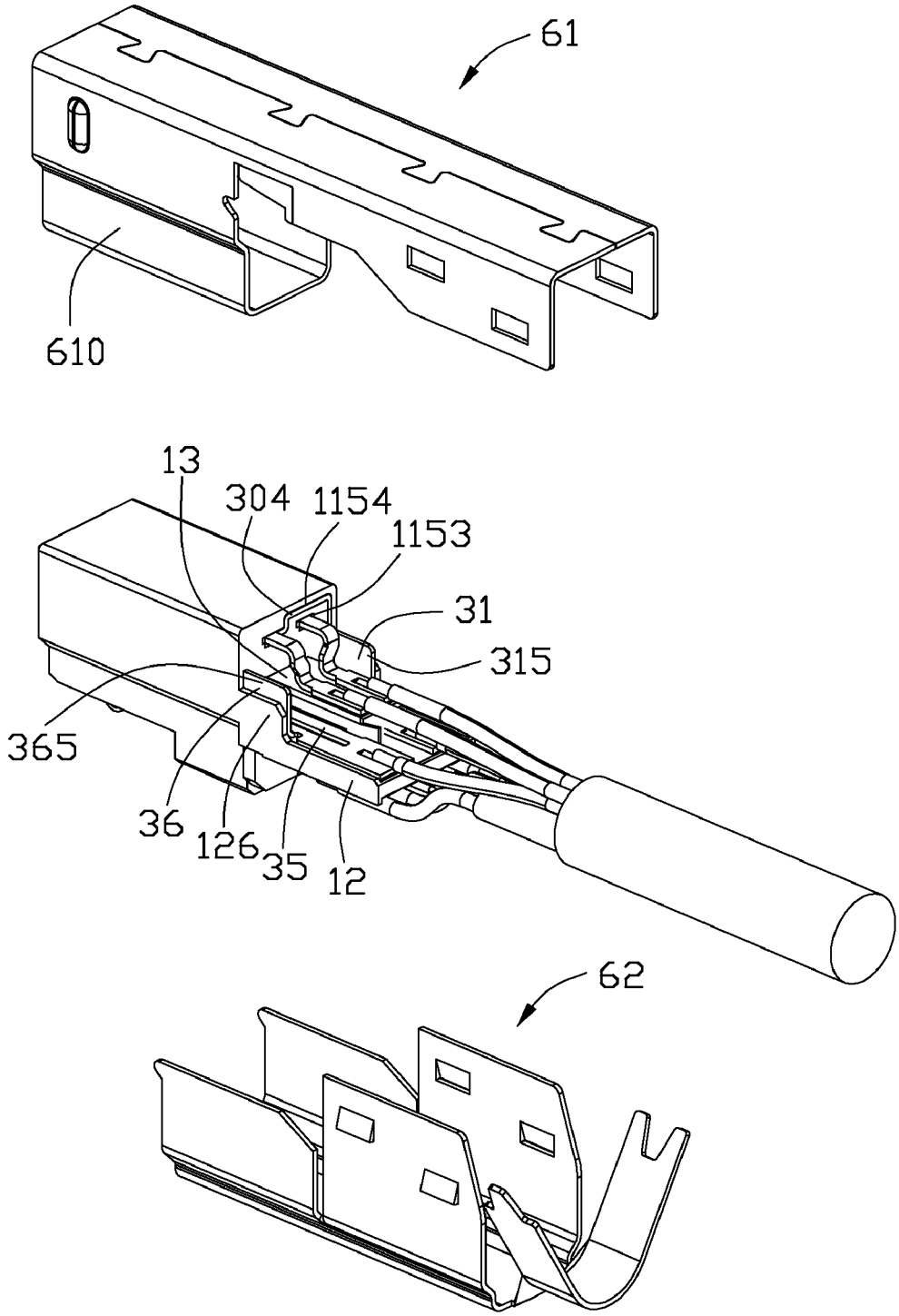
FIG. 4 is similar to FIG. 3, but viewed from another aspect.
Figure 5:
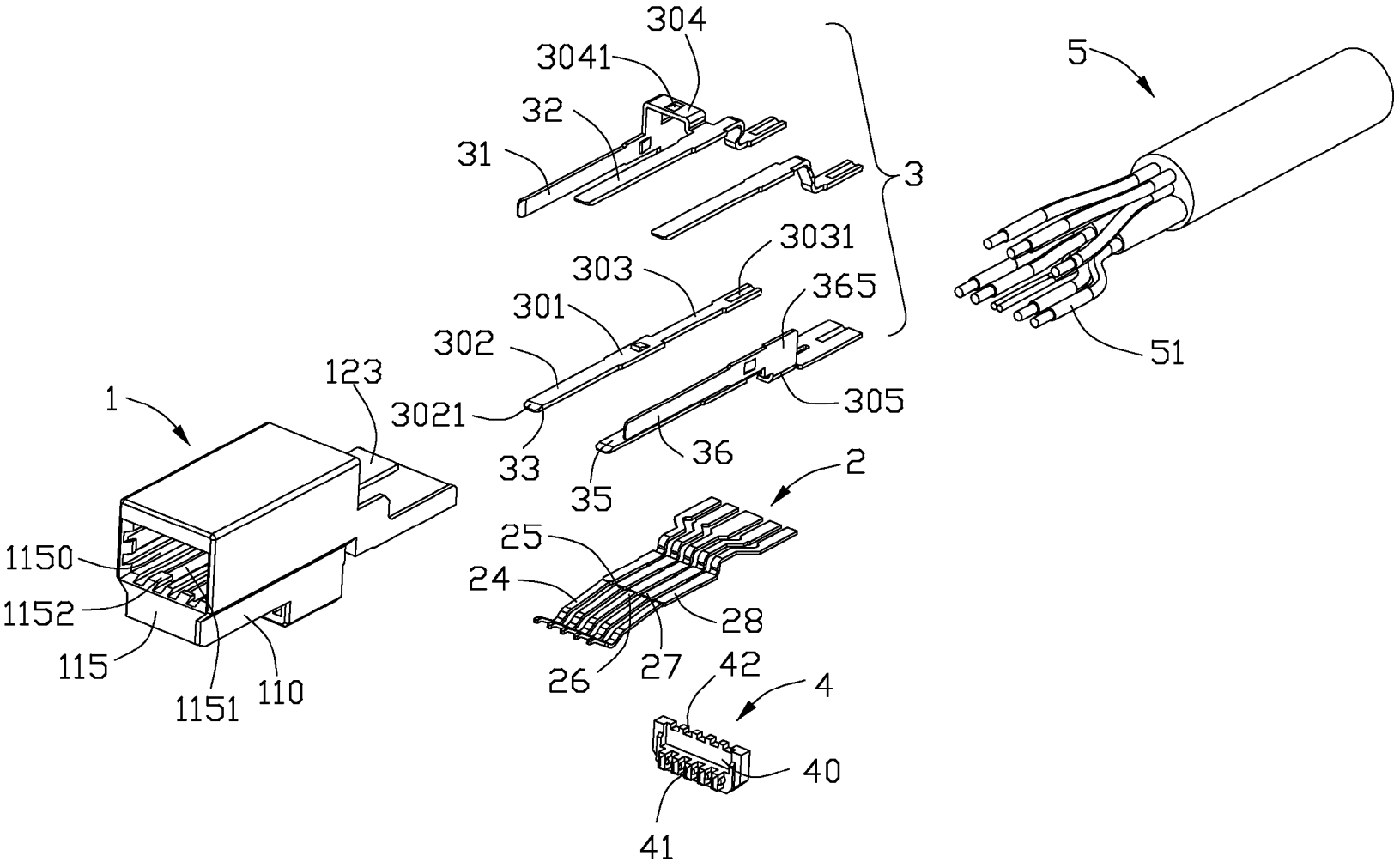
FIG. 5 is a perspective view of the electrical plug with a metal shell removed therefrom shown in FIG. 3.
Figure 6:
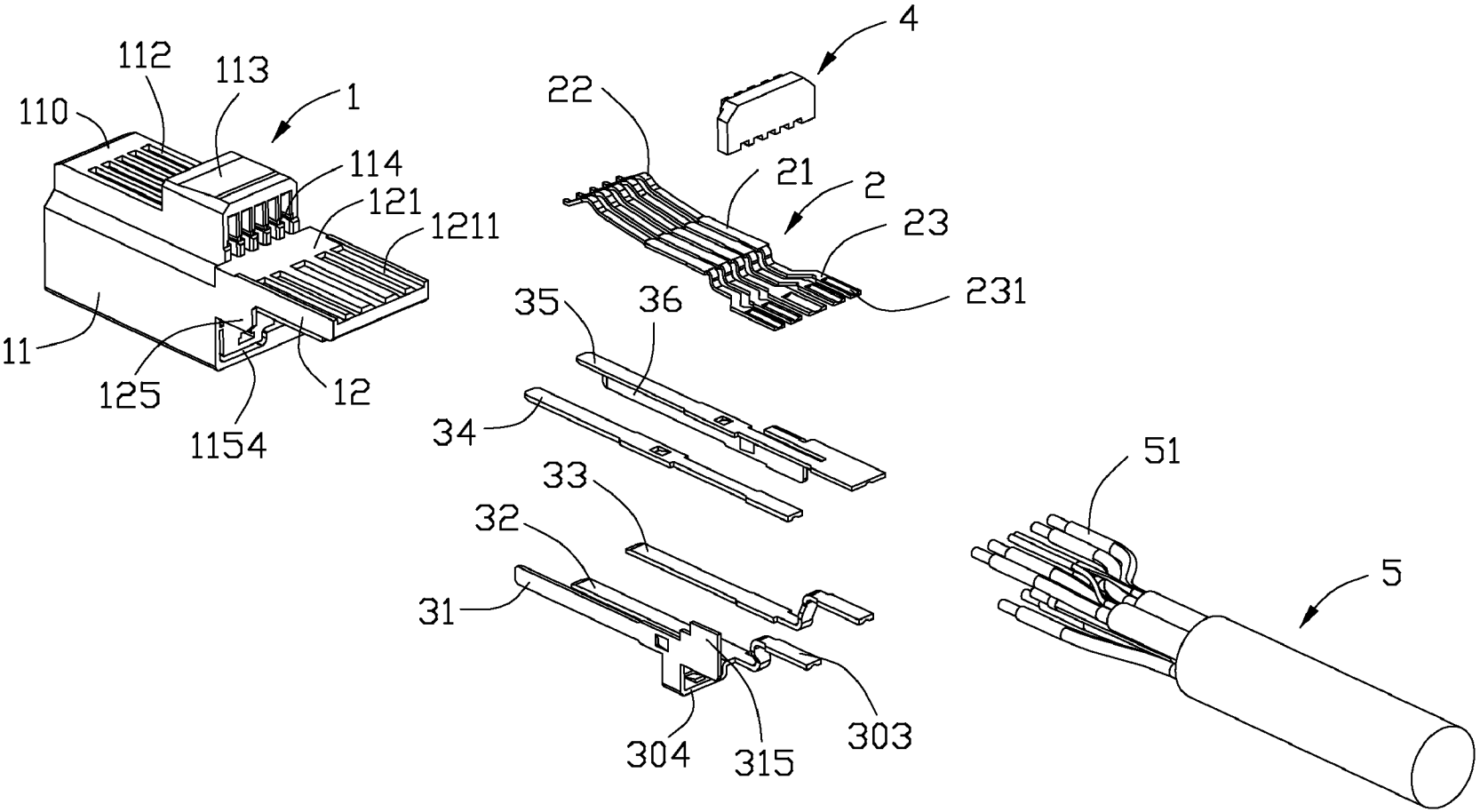
FIG. 6 is similar to FIG. 5, but viewed from another aspect.
Figure 7:
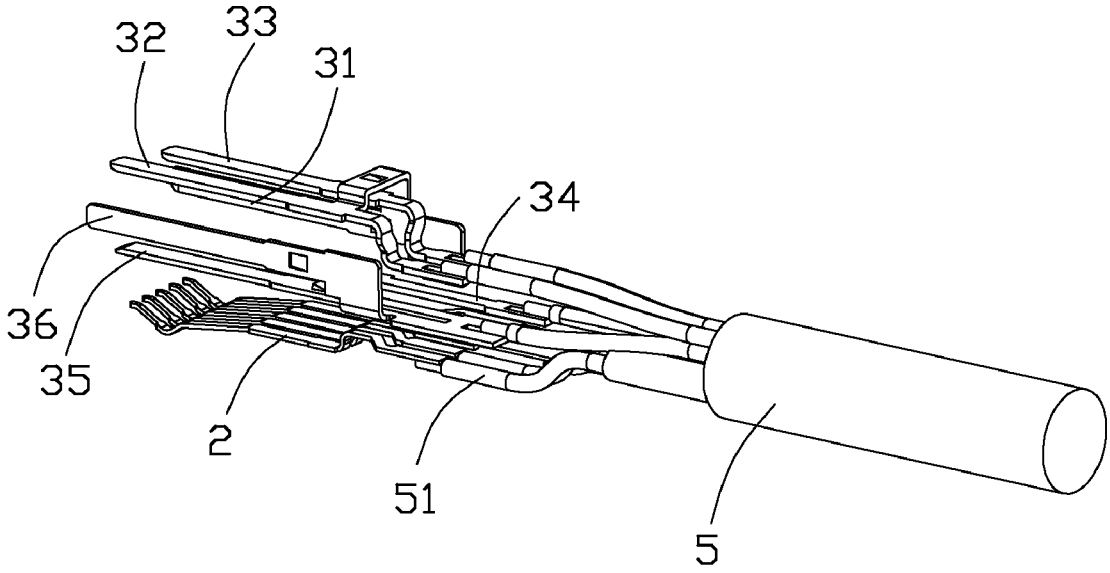
FIG. 7 is a perspective view showing a set of first and second contacts connecting with a cable in the electrical plug.

Referring to FIGS. 1-3, an electrical connector according to a preferred embodiment of the present invention is an electrical plug 100. The electrical plug 100 is a B-type USB 3.0 plug. The electrical plug 100 includes an insulative housing 1, a plurality of first and second contacts 2, 3 retained in the insulative housing 1, a spacer 4 assembled to the insulative housing 1 for retaining the first and second contacts 2, 3, a cable 5 connecting with the first and second contacts 2, 3, a metal shell 6 enclosing the insulative housing 1 for EMI protection, and a plastic case 7 surrounding the metal shell 4 and a front portion of the cable 5.

Referring to FIGS. 1-7, the insulative housing 1 is molded of dielectric material such as plastic or the like, and includes a main portion 11 having an upper separate plate 110, a standoff 113 extending upwardly from an upper surface of the separate plate 110, a first and second supporting plates 12, 13 extending backwardly from a rear face of the main portion 11 and spaced apart from each other along a height direction of the insulative housing 1. A first chamber 101 is formed between the shell 6 and the upper separate plate 110. A second chamber 1150 is recessed backwardly from a front face 115 of the main portion 11. The insulative housing 1 has a plurality of first passageways 112 communicating with the first chamber 101 and recessed downwardly from the upper surface of the upper separate plate 110, and a plurality of first holes 114 passing through the standoff 113 and communicating with the first passageways 112. The insulative housing 1 has a plurality of second passageways 1151 communicating with the second chamber 1150 and located on a top side, a bottom side and two lateral sides of the second chamber 1150, and a plurality of second holes 1153 passing through the main portion 11 backwardly and communicating with the second passageways 1151. A plurality of blocks 1152 are located at front ends of the corresponding second passageways 1151. The first supporting plate 12 has a plurality of recesses 1211 recessed downwardly from a top face 121 thereof.

The first contacts 2 are retained in the first passageways 112 and include a first pair of differential contacts 24, 25, a second pair of differential contacts 27, 28, and a first grounding contact 26 located between the first and second pairs of differential contacts 24, 25, 27, 28. Each first contact 2 has a first resilient contacting portion 22 protruding upwardly beyond the upper surface of the upper separate plate 110, a first tail portion 23 retained on the recess 1211 of the first supporting plate 12 and defining a first slot 231 for being soldered to a wire 51 of the cable 5, and a first connecting portion 21 connecting the first contacting portion 22 and the first tail portion 23. The first connecting portions 22 horizontally offset toward two lateral sides of the first contacts 2 so as to increase distances among the first tail portions 23.

The second contacts 3 are retained in the second passageways 1151 and include a third pair of differential contacts 33, 34, a second grounding contact 32, a first power contact 35, a second power contact 36, and a third grounding contact 31. The second grounding contact 32, the first power contact 35, and the third pair of differential contacts 33, 34 are configured as first type of contacts and adapted for B type USB 2.0 protocol. The third grounding contact 31 and the second power contact 36 are configured as second type of contacts and retained in the second passageways 1151 which are located at two lateral sides of the second chamber 1150. The second contacts 3 have stiff second contacting portions 302 retained in the second passageways 1151 and exposed to the second chamber 1150, second tail portions 303 defining second slots 3031 for being soldered to wires 51 of the cable 5 easily, and second connecting portions 301 connecting the second contacting portions 302 and the second tail portions 303. Each second contacting portion 302 has a front distal end 3021 positioned by the block 1152 to prevent the distal end 3021 from moving forwardly and warping toward the second chamber 1121. The second contacting portions 302 of the second power contact 36 and the third grounding contact 31 are parallel to each other and perpendicular to the second contacting portion 302 of the first power contact 35. The second and third grounding contacts 32, 31 have an U-shaped first bridge portion 304 integrally connecting therebetween and retained in a groove 1154 recessed forwardly from a rear face of the main portion 11. The third grounding contact 31 has a first enlarged portion 315 resisted inwardly by a first resisting portion 125 extending downwardly from one side of the first supporting plate 12. The first bridge portion 304 connects with the first enlarged portion 315 and the second connecting portion 301 of the second grounding contact 32 and bypasses the second connecting portion 301 of one of the third pair of differential contacts 33, 34. The first bridge portion 304 has a projection 3041 projecting therefrom for interferentially engaging with the main potion 11. The first and second power contacts 35, 36 have an L-shaped second bridge portion 305 integrally connecting therebetween and retained in the main portion 11. The second power contact 36 has a second enlarged portion 365 resisted inwardly by a second resisting portion 126 extending downwardly from the other side of the first supporting plate 12. The second bridge portion 305 connects with the second enlarged portion 365 and the second tail portion 303 of the first power contact 335. The second and third grounding contacts 32, 31 are electrically connected with each other via the first bridge 304, therefore, the second and third grounding contacts 32, 31 need only one second tail portion 303 for being soldered to one wire 51 of the cable 5 to achieve effects of grounding and prevention of static electricity. The first and second power contacts 35, 36 are electrically connected with each other via the second bridge 305, therefore, the first and second power contacts 35, 36 need only one second tail portion 303 for being soldered to one wire 51 of the cable 5 to achieve effects of transfer of power therein at the same time. Furthermore, the number of the second tail portions 303 and the wires 51 is decreased, and the soldering times is reduced. The second tail portion 303 of one of the third pair of differential contacts 33, 34 and the second tail portion 303 which is commonly owned by the second and third grounding contacts 32, 31 are retained on a bottom face 123 of the first supporting plate 12. The second tail portion 303 of the other one of the third pair of differential contacts 33, 34 and the second tail portion 303 which is commonly owned by the first and second power contacts 35, 36 are retained on a bottom face of the second supporting plate 13.

The spacer 4 has a plurality of protrusions 41 extending forwardly from a front face 40 thereof for being retained in the first holes 114 on the standoff 111 and a set of cavities 42 recessed upwardly from a lower surface thereof for retaining the first contacts 2.

The metal shell 6 includes a front shell 61 enclosing the insulative housing 1, a back shell 62 attached to the front shell 61 and a back side of the insulative housing 1. The front shell 61 is stamped from a unitary one-piece metal sheet, and comprises a tube portion 610 enclosing the main portion 11 and a drawer portion 612 extending backwardly from the tube portion 610 for latching with the back shell 62. The drawer portion 612 has a pair of resisting tabs 6121 resisting the rear face of the main portion 11. The back shell 62 has a set of protrusions 621 for latching with perforations 6123 formed on the drawer portion 612 and a latching tab 622 for latching on the standoff 113.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing defining a chamber;

a plurality of contacts retained in the insulative housing, the contacts comprising a set of first type of contacts defining contacting portions exposed to the chamber and each being positioned horizontally, and a set of second type of contacts defining contacting portions exposed to the chamber and each being positioned vertically, at least one of the first type of contacts having a shorting bridge integrally connecting with one of the second type of contacts and having a tail portion co-owned with the one of the second type of contacts for being soldered; and a metal shell enclosing the insulative housing.

2. The electrical connector according to claim 1, wherein the one of the first type of contacts is a second grounding contact, the one of the second type of contacts is a third grounding contact.

3. The electrical connector according to claim 2, wherein the first type of contacts comprise a pair of differential contacts parallel to each other along a height direction of the electrical connector and located between the second and third grounding contacts along a transverse direction perpendicular to the height direction.

4. The electrical connector according to claim 3, wherein the shorting bridge present as U-shaped and bypass the one of the pair of differential contacts for connecting with the second grounding contact and the third grounding contact.

5. The electrical connector according to claim 4, wherein the shorting bridge is retained in a groove formed on the insulative housing and defines a projection for interferentially engaging with the insulative housing.

6. The electrical connector according to claim 3, wherein the first type of contacts comprise a first power contact parallel to the second grounding contact along the height direction, the second type of contacts comprise a second power contact parallel to the second grounding contact along the transverse direction, the first type of contacts are located between the second grounding contact and the second power contact along the transverse direction, the first and second power contacts have a shorting bridge integrally connecting therebetween and commonly own one tail potion for being soldered.

7. The electrical connector according to claim 6, wherein the shorting bridge which connect the first and second power contacts presents as L-shaped and is retained in the insulative housing.

8. The electrical connector according to claim 6, wherein the chamber has a first chamber and a second chamber separated by a separate plate, the contacting portions of the first and second type of contacts are exposed to the second chamber, the contacts further comprise two pairs of differential contacts and a first grounding contact located between the two pairs of differential contacts, the contacting portions of the two pairs of differential contacts and the first grounding contact are exposed to the first chamber.

9. An electrical plug comprising:

an insulative housing defining a second chamber recessed backwardly from a front face thereof;

a metal shell enclosing the insulative housing to form a first chamber restricted by the metal shell and the insulative housing under a condition that the first chamber is located above the second chamber and is narrower than the second chamber;

a plurality of first contacts having elastic first contacting portions extending into the first chamber and first tail portions for being electrically connecting to electrical wires of a cable;

a plurality of second contacts having stiff second contacting portions extending into the second chamber and second tail portions for being electrically connecting to other electrical wires of the cable, the second contacts comprising a first power contact, a second grounding contact, a second power contact, and a third grounding contact, the second contacting portions of the first power contact and the second grounding contact being located at top and bottom sides of the second chamber and being parallel to each other along a height direction, the second contacting portions of the second power contact and the third grounding contact being located at two lateral sides of the second chamber and being parallel to each other along a transverse direction perpendicular to the height direction; wherein the second and third grounding contacts have a first bridge portion integrally connecting therebetween and commonly own one second tail portion for being connected with one electrical wire to achieve effects of grounding, the first and second power contacts have a second bridge portion integrally connecting therebetween and commonly own one tail portion for being connected with one electrical wire to achieve effects of transfer of power therein.

10. The electrical plug according to claim 9, wherein the second contacts comprises a pair of differential contacts, the second contacting portions of the differential contacts are located at top and bottom sides of the second chamber and being parallel to each other along the height direction, the second contacting portions of the differential contacts are located between the contacting portions of the second and third grounding contacts along the transverse direction.

11. The electrical plug according to claim 10, wherein the first bridge present as U-shaped and bypass one of the pair of differential contacts which is located at bottom side of the second chamber for connecting with the second grounding contact and the third grounding contact.

12. The electrical plug according to claim 11, wherein the first bridge portion is retained in a groove formed on the insulative housing and define a projection for interferentially engaging with the insulative housing.

13. The electrical plug according to claim 10, wherein the insulative housing has a first and second supporting plates extending backwardly therefrom and parallel to each other along the height direction, the first tail portions are retained on a top face of the first supporting plate, the second tail portion of one of the pair of differential contacts which is located at top side of the second chamber and the second tail portion which is commonly owned by the second and third grounding contacts are retained on a bottom face of the first supporting plate, the second tail portion of the other one of the pair of differential contacts and the second tail portion which commonly owned by the first and second power contacts are retained on a bottom face of the second supporting plate.

14. The electrical plug according to claim 13, wherein the third grounding contact has a first enlarged portion resisted inwardly by a first resisting portion extending downwardly from one side of the first supporting plate, the second grounding contact has a second connecting portion connecting the second contacting portion and the second tail portion, the first bridge portion connects with the first enlarged portion and the second connecting portion.

15. The electrical plug according to claim 14, wherein the second power contact has a second enlarged portion resisted inwardly by a second resisting portion extending downwardly from the other side of the first supporting plate, the second bridge portion connects with the second enlarged portion and the second tail portion of the first power contact.

16. An electrical connector comprising:

an insulative housing defining opposite first and second side walls and opposite third and fourth side walls all together forming a mating cavity with a rectangular contour;

a plurality of first contacts disposed in the housing with first contacting sections exposed upon the first side wall and facing toward the mating cavity; and a plurality of second contacts disposed in the housing with second contacting sections exposed in the second side wall and facing toward the mating cavity;

wherein one of said first contacts further defines one additional first contacting section exposed upon the third side wall and facing toward the mating cavity, and one of said second contacts defines one additional second contacting section exposed upon the fourth side wall and facing toward the mating cavity.

17. The electrical connector as claimed in claim 16, wherein said first, second, third and fourth side walls commonly inwardly form and surround said mating cavity.

18. The electrical connector as claimed in claim 16, wherein said first contacting sections and said second contacting sections are essentially stiff during mating.

19. The electrical connector as claimed in claim 16, wherein each of the first contacting section and the additional first contacting section has a corresponding retention means thereabouts.

20. The electrical connector as claimed in claim 16, wherein an L-shaped structure is located between the first contacting section and the additional first contacting section.

* * * * *